US006862862B2

(12) United States Patent
Ward

(10) Patent No.: US 6,862,862 B2
(45) Date of Patent: Mar. 8, 2005

(54) PRESSURE INJECTION OF FLEXIBLE POLYMER GROUT INTO SLATE ROOFS

(76) Inventor: Stanley P. Ward, 4261 Shangri-La Rd., Stewartstown, PA (US) 17363

( * ) Notice: Subject to any disclaimer, the term of this patent is extended or adjusted under 35 U.S.C. 154(b) by 52 days.

(21) Appl. No.: 10/266,023

(22) Filed: Oct. 7, 2002

(65) Prior Publication Data

US 2003/0029132 A1 Feb. 13, 2003

(51) Int. Cl.[7] ..... E04G 23/00

(52) U.S. Cl. ..... 52/742.16; 52/514.5; 264/35; 427/140

(58) Field of Search ..... 52/742.16, 514.5, 52/516, 742.12, 741.3, 741.4, 749.12, 749.11, DIG. 1; 264/35, 261, 309; 427/140, 286, 421.1, 331, 356; 156/94, 98, 71; 222/529

(56) References Cited

U.S. PATENT DOCUMENTS 3,996,396 A 12/1976 Hansen et al. ..... 427/140
4,241,107 A 12/1980 Mandish et al. ..... 427/140
4,386,981 A 6/1983 Clapperton ..... 156/71
5,120,607 A 6/1992 Ingle ..... 428/423.1
5,372,855 A * 12/1994 Hamada et al. ..... 427/393.6
5,457,924 A 10/1995 Fujii ..... 52/396.1
9,950,326 9/1999 Scott ..... 34/309

OTHER PUBLICATIONS

Deborah Fugitt, "CER–COAT Roofing Mastic", 1998, Lone Star Epoxies, website: Isepoxies.de/CER–COAT.html.*

* cited by examiner

*Primary Examiner*—Naoko Slack
(74) *Attorney, Agent, or Firm*—Larry J. Guffey

(57) ABSTRACT

A method is presented for extending the lives of existing slate, fibrous cement and clay tile roofs. The method involves injecting an especially formulated, polymer material into the spaces and voids of adjoining tiles. The injection process uses pumping equipment with a custom-designed gasket at the spray gun's point of application to aid in directing the grout into the spaces and voids.

12 Claims, 4 Drawing Sheets

PRESSURE INJECTION OF FLEXIBLE POLYMER GROUT INTO SLATE ROOFS

BACKGROUND OF THE INVENTION

1. Field of the Invention

This invention relates to grouting/caulking processes. More particularly, this invention relates methods and apparatus for extending the life of and restoring the water resistance to aging slate, fibrous cement or clay tile roofs.

2. Description of Prior Art

Slate tiles have been used as roofing materials for hundreds of years. Slate roofs, if properly maintained, can last for sixty to one hundred twenty five or more years; keeping the integrity of the buildings on which they are used intact and adding to the building's value.

The slate roofing industry reached its zenith in both quantity and value of output from 1897 to 1914. Consequently, many of the prominent structures constructed during that time have slate roofs that are nearing the end of their serviceable lives.

The durability of these roofs depends on many factors, one of which is the physical and mineralogical properties of slate. The natural weathering of roofing slate is a slow process of chipping and scaling of the slate along its cleavage planes. Paper-thin laminations flake off the slate surface, and the surface becomes soft and spongy as the inner layers begin to come apart, or delaminate. This process is often accelerated by the phenomena of reverse condensation in which moisture condenses on the bottom sides of the roofing slates and aids in the deterioration of the undersides of the roofing slates and the fasteners or nails that hold the slates in place.

As this weathering process continues, there is a decrease in both the strength and toughness of the slate tiles. Unless something is done to stop or decrease this weathering process, a number of the tiles that comprise a slate roof are likely to eventually break or fall out of place.

The most viable, current repair method for slate roofs is to simply replace the roof's deteriorated or broken tiles. However, there are numerous potential problems with such repairs. These include: (a) the impracticality of such repairs when there are numerous damaged tiles in a roof, (b) the possibility that even the most experienced roofing installers will damage other tiles while attempting such repairs, and (c) the frequent impossibility of replacing the damaged tiles with tiles of the same color or hue; thereby resulting in a "patchwork" of miscolored tiles that detracts from the roof's overall aesthetic appearance.

Other repair methods present even greater problems. The slate roofing industry does not consider the application of bituminous mastics or other non-permeable materials to be viable repair alternatives. These materials, though effective at first, will eventually harden and crack, allowing water to enter the tiles. The trapped moisture that results in these situations will worsen the effects of the natural freeze/thaw cycles. Also, the application of mastic materials to slate roofs makes future repairs more difficult to execute.

Thus, there exists a continuing need for the development of new and improved repair and preservation methods for slate roofs. Such methods should preferably be relatively easy to implement, and not too labor intensive or require the use of costly materials so that such repairs can be made in a cost-effective and timely manner.

OBJECTS AND ADVANTAGES

There has been summarized above, rather broadly, the prior art that is related to the present invention in order that the context of the present invention may be better understood and appreciated. In this regard, it is instructive to also consider the objects and advantages of the present invention.

It is an object of the present invention to provide an improved method for maintaining and repairing slate, fibrous cement or clay tile roofs.

It is another object of the present invention to provide a method for maintaining and repairing slate, fibrous cement or clay tile roofs that yields a stronger, monolithic roof membrane after the repair is made.

It is yet another object of the present invention to minimize the natural grain splitting that often occurs in roofing tiles.

It is an object of the present invention to prevent, in a tile roof, the fall-out of broken pieces of roofing tiles and the infiltration of wind-driven water or melting ice and snow.

It is a further object of the present invention to minimize and even eliminate the detrimental effects of the phenomena of "reverse condensation" in roofing slates and the fasteners that hold the slates in place.

These and other objects and advantages of the present invention will become readily apparent as the invention is better understood by reference to the accompanying summary, drawings and the detailed description that follows.

SUMMARY OF THE INVENTION

Recognizing the need for the development of an improved method for maintaining and repairing slate, fibrous cement or clay tile roofs, the present invention is generally directed to satisfying the needs set forth above and overcoming the disadvantages identified with prior art methods.

In accordance with the present invention, the foregoing need can be satisfied by utilizing a process for preserving and extending the life of an existing roof that is comprised the steps of: (a) powerwashing the roof and replacing any damaged tiles, (b) injecting a polymer, grouting material into the spaces and voids between the joints of the tiles of the existing roofing, and (c) performing this injection step with the use of spray gun equipment that is equipped with a gasket at the spray gun's exit to aid in directing the grout into the spaces and voids, wherein the grouting material is a specially formulated, water-based mixture comprising acrylic polymer, microspheres, antibiological agents, and pulverized slate that are mixed in proportions so as to yield desired physical properties of the grouting material.

In a preferred embodiment of the present invention, the gasket used in this process is made from a foam material and has a front face surface that is concave. This design aids in forcing the grout into the roof's voids while pressure is used to compress the edges of the gasket's front face so as to form a seal with the roof to minimize excess accumulation of grout on the roof's top surface.

Thus, there has been summarized above, rather broadly, the present invention in order that the detailed description that follows may be better understood and appreciated. There are, of course, additional features of the invention that will be described hereinafter and which will form the subject matter of any eventual claims to this invention.

DETAILED DESCRIPTION OF THE PREFERRED EMBODIMENT

Figure 1A:
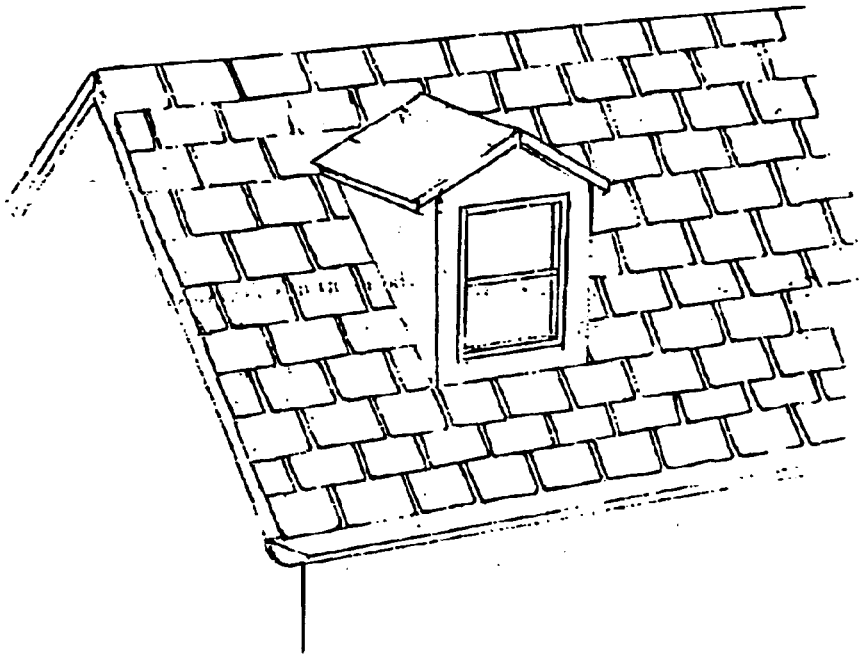
FIG. 1(*a*) is a front view and FIG. 1(*b*) is a side view showing the general means of construction for a tile roof and illustrating the voids and crevices that exist within the roof.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 1B:
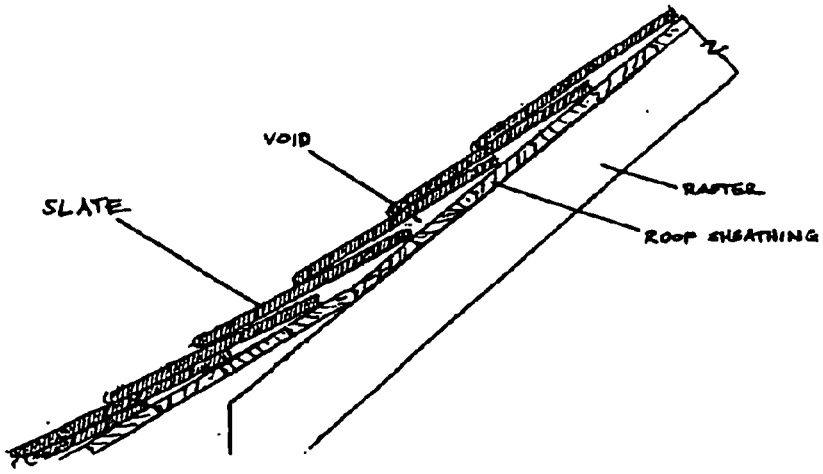

The present invention involves the pressure injection of a flexible, polymer grout into the crevices and overlap spaces created within a slate roof. See FIGS. 1(*a*)–1(*b*) which show a front and side view of a slate roof and its crevices, overlap spaces and voids. This caulk-like polymer is used to fill all the voids in a slate roof, including the rain slots between the tiles.

The slate roof surface is prepared for the application of the flexible polymer grout by powerwashing it to clean the slates and wash away any debris on the roof. Any broken slates that would affect the waterproofing characteristics of the roof are repaired or replaced.

Figure 2:
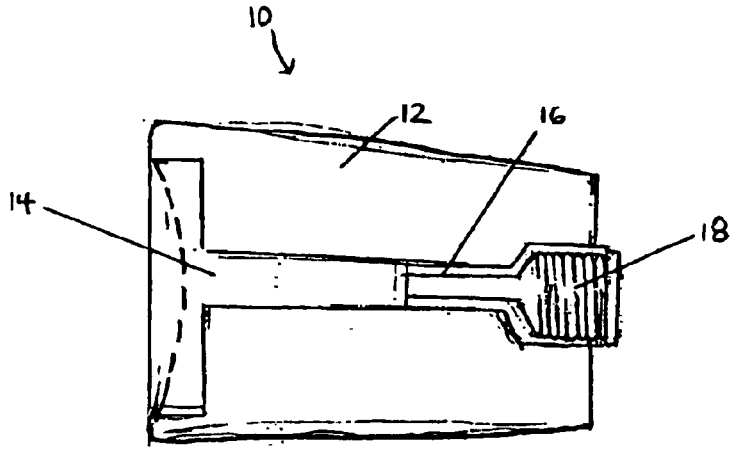
FIG. 2 is a cross-sectional view of the gasketed application tool of the present invention that is used to pressure inject grout into a tile roof's voids.
Figure 3:
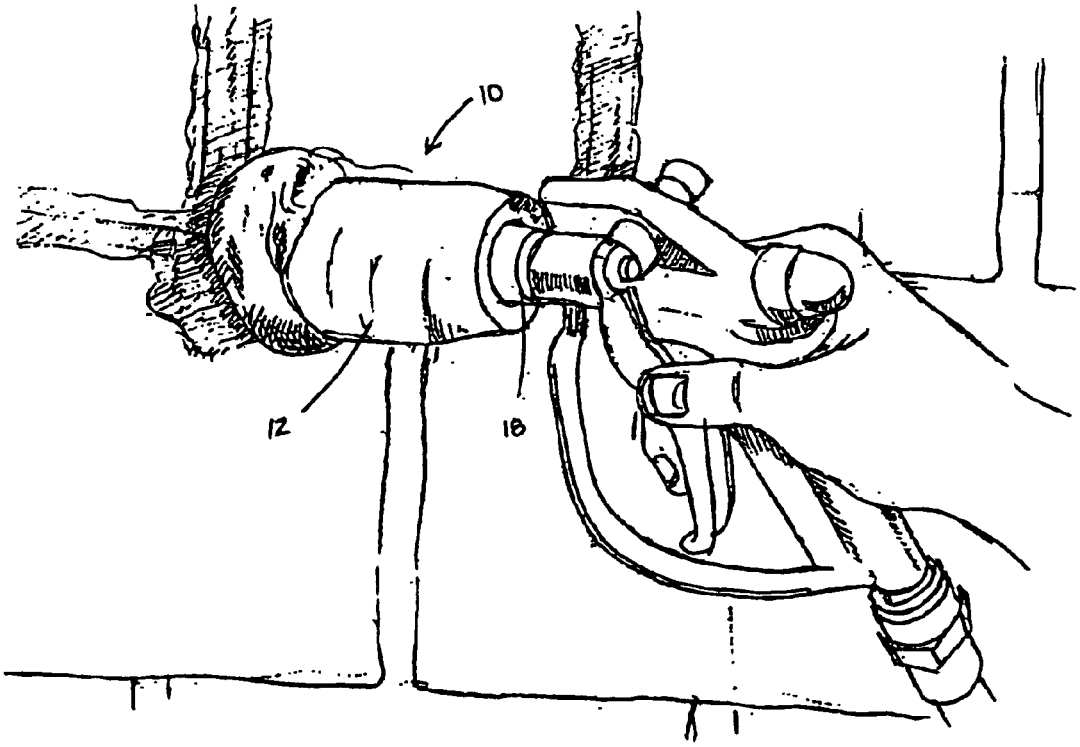
FIG. 3 is a view of an applicator tool being used to apply grout to slate crevices.
Figure 4:
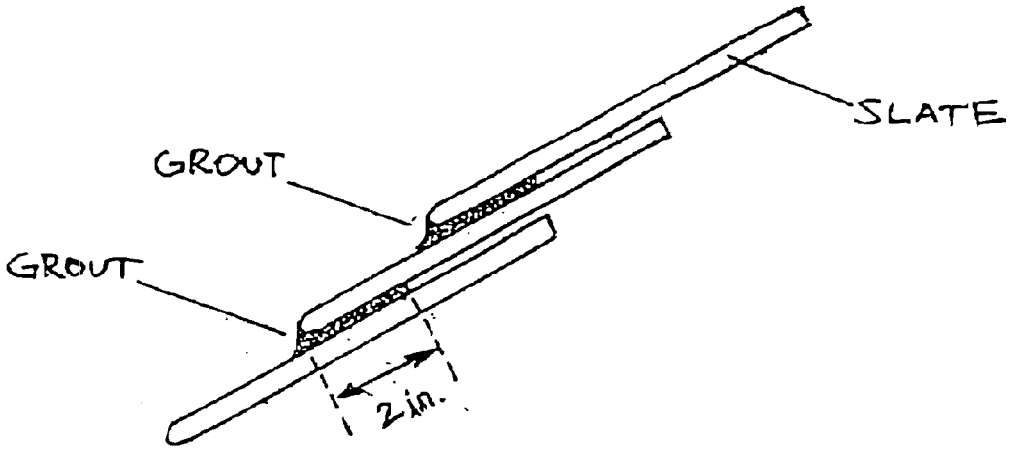
FIG. 4 is a cut-away view of a slate roof grouted by the present invention and showing the grout underneath as well as between the slates.

The applicator who is applying the grout can begin the application process at any point on the roof that is logistically convenient. The applicator use an especially designed, gasketed application tool 10, see FIG. 2, to apply the grout manually. This tool 10 is used to inject the polymer grout into all the voids and slots between every slate tile on the roof, see FIG. 3 and FIG. 4.

The gasket 12 portion of this tool 10 is made of ethylene vinyl acetate (EVA), ethylene propylene diene monomer (EPDM) or neoprene vinyl nitrite (PVC-NVR) foam that can be configured in various select densities so that it has compressibility characteristics which allow the gasket 12 to be optimally compressed against the roofing slates. This gasket typically measures about two to three inches in diameter and has a front face surface 14 that is concave or cup-shaped. The geometry of the gasket's front face surface allows the grout to form something of a pool of grouting material on this front face surface as it is being injected into the roof's voids. It is impeded from flowing laterally on the roof by the applicator applying downward force on the gasket 12 as to cause the foam material at the edges of the front face to be compressed so as to seal the pooled grout in the concave area of the front face before it is pressure injected into the roof's voids.

This gasket material is manufactured in different foam densities and different gasket diameters for different textures of the roofing elements. The concave nature of the gasket's face allows the grout to be forced into the roof's voids while pressure is used to compress the gasket against the roof surface so as to minimize excess accumulation of grout on the roof surface.

Figure 5:
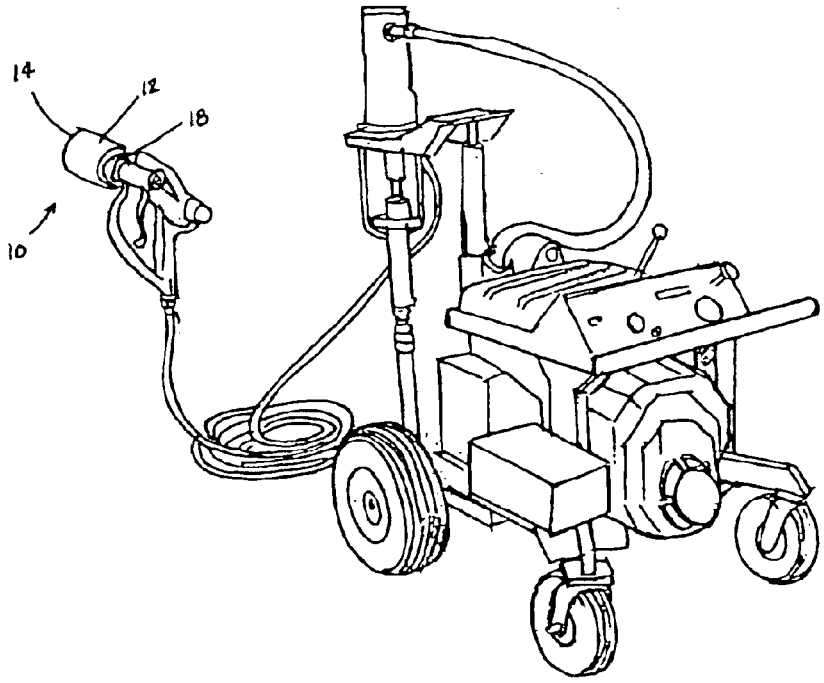
FIG. 5 shows a type of hydraulic airless sprayer that is suitable for pumping the grout to the applicator tool.

Grout is fed into this gasket and the applicator tool 10 by tubing 16 that is approximately 0.5 inches in diameter in the vicinity of the gasket. This tubing terminates approximately 1.5 inches below the face of the gasket. Adhesive adheres the gasket to the tubing 16. The tubing is connected by a flare and flare nut 18 to standard spray gun equipment consisting of one inch diameter (at the pump), high-pressure hydraulic hose and a large orifice flow control device (e.g., a mastic gun). This equipment is used to pump the grout from a pump source on the ground to the applicator tool, see FIG. 5. Pumping pressures of 1600 psi to 2000 psi are recommended to pump this relatively viscous grout at workable flowrates.

Figure 6:
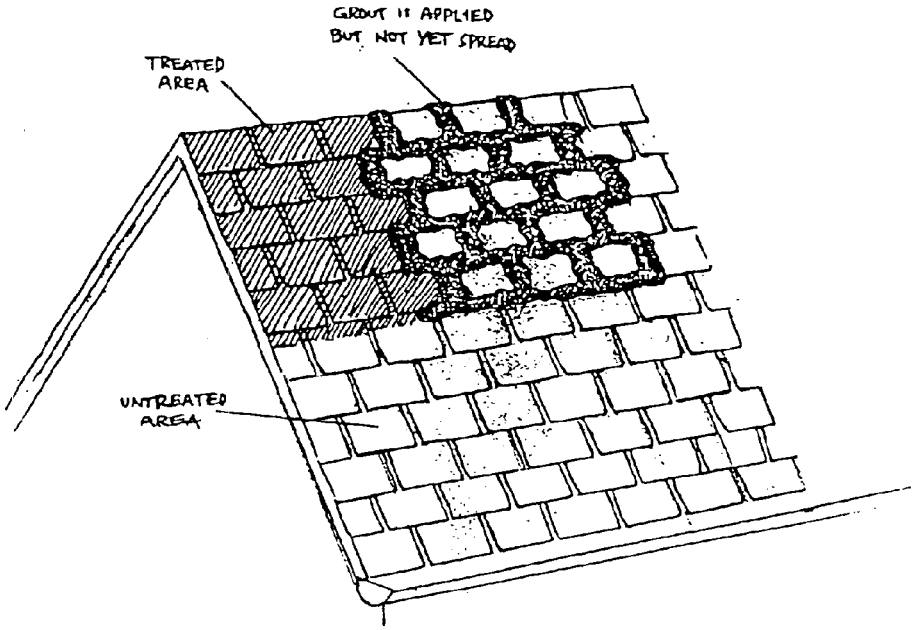
FIG. 6 is a perspective view showing the various areas of a slate roof being treated with the process of the present invention: (a) an area where the voids have been filled with grout and the outer surfaces of the slates given a thin, breathable film layer of the grout material, (b) an area in which the grout has been applied to the crevices and voids, but the initially excess grout material has not yet been spread over the outer surfaces of the slates, and (c) an untreated area of the roof.
Figure 7:
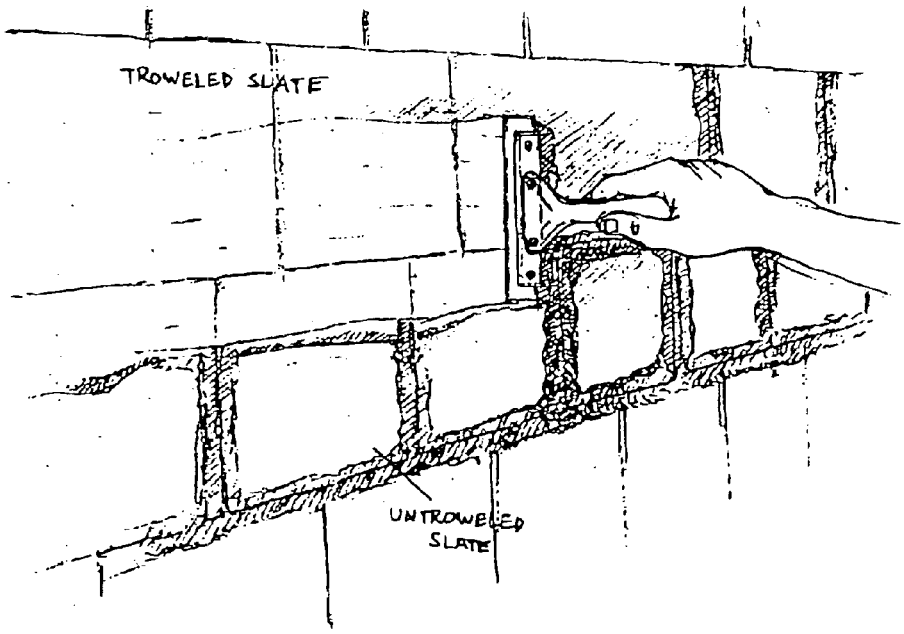
FIG. 7 depicts the troweling or smoothing step that removes any excess grout and leaves a thin film of grout on the slates

The gasket 12 of the applicator tool allows the applicator to fill roofing voids to desired grout depths. The applicator attempts to maintain a smooth, wet edge on the applied grout at all times. See FIG. 6 which shows the various areas of slate roof being treated with the process of the present invention. Three distinct areas of the roof can be distinguished: (a) an area where the voids have been filled with grout and the outer surfaces of the slates given a thin, breathable film layer of the grout material, (b) an area in which the ground has been applied to the crevices and voids, but the initially excess grout material has not yet been spread over the outer surfaces of the slates, and (c) an untreated area of the roof. This grout spreading step can be efficiently accomplished by using a squeegee or a trowel-like tool, see FIG. 7.

The speed of this application process is proportional to the size and spacing of the void between the tiles; i.e., more time and grout are needed to fill a greater number of larger voids. Given the unique nature of each slate roof, the total time periods required for application of this grout to a certain size roof will show considerable variability. Typical coverage rates will vary from 1.5 to 2.5 gallons of polymer per one hundred square feet of roof surface. Once applied, the grout needs up to seven days to cure and provide complete protection for the roof.

The grout used in this process is a special acrylic polymer with selected solids or aggregates and microspheres added to provide the desired adhesion, wetability, slump, and other designed properties of the grout. The grout and the application tool are available from Slate Savers, 63 North Main Street, Suite H, Stewartstown, Pa. 17363. Additional information regarding this materials can be found at www.slatesavers.com.

This grout can be formulated in various colors. For example, it is currently available in three versions, a dark grout for use with gray slates, a grout with red overtones for red slates and a grout with green overtones for use on green slates. Additionally, it can be formulated with fungicides and mildecides to resist bacterial growth within the grout, and with ultraviolet light screening agents to minimize sun damage to a treated roof.

The present invention offers several, distinct advantages over other repair procedures. This grouting process yields a stronger, monolithic roof membrane as: (a) each tile is "glued/grouted" to six of its neighbors, (b) the detrimental effects of "reverse condensation" are minimized, and (c) the top surfaces of the roofing tiles are afforded greater surface protection by the thin, breathable film that is adhered to them. Through this additional strength, the process minimizes the natural grain splitting of the tiles, and it permits thermal dimensional changes through the grout's flexibility. The grouting process also prevents fall-out of broken pieces whose fasteners have failed, as well as the infiltration of wind-driven water or melting ice and snow dams.

The techniques of the present invention also have the advantage of not negating the natural moisture vapor permeability of the slate roof. Additionally, the grout recommended for use in this process possesses good stability to ultraviolet light exposure. Thus, this grouting process preserves the aesthetics of the original slate roof, the only noticeable change being a very slight darkening of the tiles which actually gives them a semblance of "newness." Meanwhile, this grouting process does not produce a coated roof, such as has been done (unsuccessfully) with bituminous materials. Through exposure to the elements, the thin film left by the grouting process gradually wears away after several years.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

I claim:

1. A process for preserving and extending the life of an existing roof comprised of roofing elements and joints between said elements, said roofing elements chosen from the group consisting of slates and fibrous cement or clay tiles, said process comprising the steps of:

injecting a polymer grout into the spaces and voids between the joints of roofing elements of said existing roofing, and performing said injecting step with the use of injection equipment that is equipped with a gasket at the equipment's exit to aid in directing said grout into said spaces and voids.

2. The process as recited in claim 1, further comprising the steps of:

prior to injecting said grouting material, preparing the surface of said roof by powerwashing said roof.

3. The process as recited in claim 2, further comprising the steps of:

prior to injecting said grout, preparing the surface of said roof by replacing any damaged roofing elements that affect the water proofing characteristics of said roof.

4. The process as recited in claim 3, wherein said grout is a specially formulated, water-based mixture comprising materials chosen from the group consisting of acrylic polymer, antibiological agents, and pulverized slate, and with the chosen materials being mixed in proportions so as to yield desired physical properties of said grout.

5. The process as recited in claim 1, wherein said gasket is made from a foam material of specified density and has a front face surface that is concave.

6. The process as recited in claim 2, wherein said grout is a specially formulated, water-based mixture comprising materials chosen from the group consisting of acrylic polymer, antibiological agents, and pulverized slate, and with the chosen materials being mixed in proportions so as to yield desired physical properties of said grout.

7. The process as recited in claim 6, wherein said gasket is made from a foam material of specified density and has a front face surface that is concave.

8. The process as recited in claim 2, wherein said gasket is made from a foam material of specified density and has a front face surface that is concave.

9. The process as recited in claim 1, further comprising the steps of:

prior to injecting said grout, preparing the surface of said roof by replacing any damaged roofing elements that affect the water proofing characteristics of said roof.

10. The process as recited in claim 9, wherein said grout is a specially formulated, water-based mixture comprising materials chosen from the group consisting of acrylic polymer, antibiological agents, and pulverized slate, and with the chosen materials being mixed in proportions so as to yield desired physical properties of said grout.

11. The process as recited in claim 1, wherein said grout is a specially formulated, water-based mixture comprising materials chosen from the group consisting of acrylic polymer, antibiological agents, and pulverized slate, and with the chosen materials being mixed in proportions so as to yield desired physical properties of said grout.

12. The process as recited in claim 11, wherein said gasket is made from a foam material of specified density and has a front face surface that is concave.

* * * * *